US008712281B2

(12) United States Patent
Nakano et al.

(10) Patent No.: US 8,712,281 B2
(45) Date of Patent: Apr. 29, 2014

(54) IMAGE FORMING APPARATUS

(75) Inventors: Hiroshi Nakano, Nagoya (JP); Hirotaka Mori, Nagoya (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 174 days.

(21) Appl. No.: 13/349,781

(22) Filed: Jan. 13, 2012

(65) Prior Publication Data

US 2012/0183323 A1 Jul. 19, 2012

(30) Foreign Application Priority Data

Jan. 14, 2011 (JP) ..... 2011-005923

(51) Int. Cl.
*G03G 15/00* (2006.01)

(52) U.S. Cl.
USPC ..... 399/110

(58) Field of Classification Search
USPC ..... 399/108, 110
See application file for complete search history.

(56) References Cited

U.S. PATENT DOCUMENTS

| | | | | |
|---|---|---|---|---|
| 8,005,397 | B2 | 8/2011 | Sato | |
| 8,311,437 | B2 | 11/2012 | Sato | |
| 8,594,530 | B2 * | 11/2013 | Sato et al. | 399/110 |
| 2009/0142092 | A1 * | 6/2009 | Sato | 399/111 |
| 2009/0169245 | A1 | 7/2009 | Sato | |
| 2009/0190953 | A1 * | 7/2009 | Okabe | 399/111 |
| 2011/0293324 | A1 | 12/2011 | Hoashi | |
| 2012/0183325 | A1 * | 7/2012 | Sato et al. | 399/110 |
| 2012/0207511 | A1 * | 8/2012 | Sato | 399/110 |

FOREIGN PATENT DOCUMENTS

| | | | |
|---|---|---|---|
| JP | 08-036346 | A | 2/1996 |
| JP | 2001-175046 | | 6/2001 |
| JP | 2007-199733 | A | 8/2007 |
| JP | 2008-003340 | A | 1/2008 |
| JP | 2009-009119 | A | 1/2009 |
| JP | 2009-139495 | A | 6/2009 |
| JP | 2009-175416 | | 8/2009 |
| JP | 2010-244018 | A | 10/2010 |

OTHER PUBLICATIONS

Office Action received in corresponding Japanese Patent Application No. 2011-005923, dated Jan. 22, 2013.

* cited by examiner

*Primary Examiner* — Walter L Lindsay, Jr.
*Assistant Examiner* — Frederick Wenderoth
(74) *Attorney, Agent, or Firm* — Banner & Witcoff, Ltd.

(57) ABSTRACT

A photosensitive-drum supporting member has a pair of side walls confronting both ends of each photosensitive drum. The photosensitive-drum supporting member supports the photosensitive drums between the side walls. The photosensitive-drum supporting member moves between: a stowed position at which the photosensitive-drum supporting member is stowed within an apparatus main body; and a moved position at which the photosensitive-drum supporting member is moved from the stowed position to outside the apparatus main body through an opening. Exposing members are provided at the photosensitive-drum supporting member such that the exposing members move between: an exposing position at which each exposing member is adjacent to a corresponding photosensitive drum; and a retracted position at which each exposing member is separated from the corresponding photosensitive drum and is engaged by an engaging part. The exposing members are accommodated within the photosensitive-drum supporting member both at the exposing position and at the retracted position.

17 Claims, 14 Drawing Sheets

IMAGE FORMING APPARATUS

CROSS REFERENCE TO RELATED APPLICATIONS

This application claims priority from Japanese Patent Application No. 2011-005923 filed Jan. 14, 2011. The entire content of the priority application is incorporated herein by reference.

TECHNICAL FIELD

The invention relates to an image forming apparatus.

BACKGROUND

An image forming apparatus is conventionally known that includes a plurality of photosensitive drums and a plurality of LED heads arranged above the plurality of photosensitive drums.

SUMMARY

In the above-mentioned image forming apparatus, when the plurality of photosensitive drums and the plurality of LED heads are moved to outside an apparatus main body, there is a possibility that the plurality of LED heads interfere with another member or a user touches an exposing surface of the LED head, which adversely affects printing.

In view of the foregoing, it is an object of the invention to provide an image forming apparatus that is configured to protect an exposing member such as an LED head.

In order to attain the above and other objects, the invention provides an image forming apparatus. The image forming apparatus includes an apparatus main body, a plurality of photosensitive drums, a plurality of exposing members, and a photosensitive-drum supporting member. The apparatus main body has an opening. The plurality of photosensitive drums each has both ends in an axial direction. The plurality of exposing members is each configured to expose a corresponding one of the plurality of photosensitive drums to light for forming an electrostatic latent image on the corresponding one of the plurality of photosensitive drums. The photosensitive-drum supporting member has a pair of side walls confronting the both ends of each of the plurality of photosensitive drums. The photosensitive-drum supporting member is configured to support the plurality of photosensitive drums between the pair of side walls. The photosensitive-drum supporting member is configured to move between: a stowed position at which the photosensitive-drum supporting member is stowed within the apparatus main body; and a moved position at which the photosensitive-drum supporting member is moved from the stowed position to outside the apparatus main body through the opening. The plurality of exposing members is provided at the photosensitive-drum supporting member such that the plurality of exposing members is configured to move between: an exposing position at which each of the plurality of exposing members is adjacent to the corresponding one of the plurality of photosensitive drums; and a retracted position at which each of the plurality of exposing members is separated from the corresponding one of the plurality of photosensitive drums and is engaged by an engaging part. The plurality of exposing members is accommodated within the photosensitive-drum supporting member both at the exposing position and at the retracted position.

BRIEF DESCRIPTION OF THE DRAWINGS

Embodiments in accordance with the invention will be described in detail with reference to the following figures wherein.

DETAILED DESCRIPTION

First Embodiment

Figure 1:
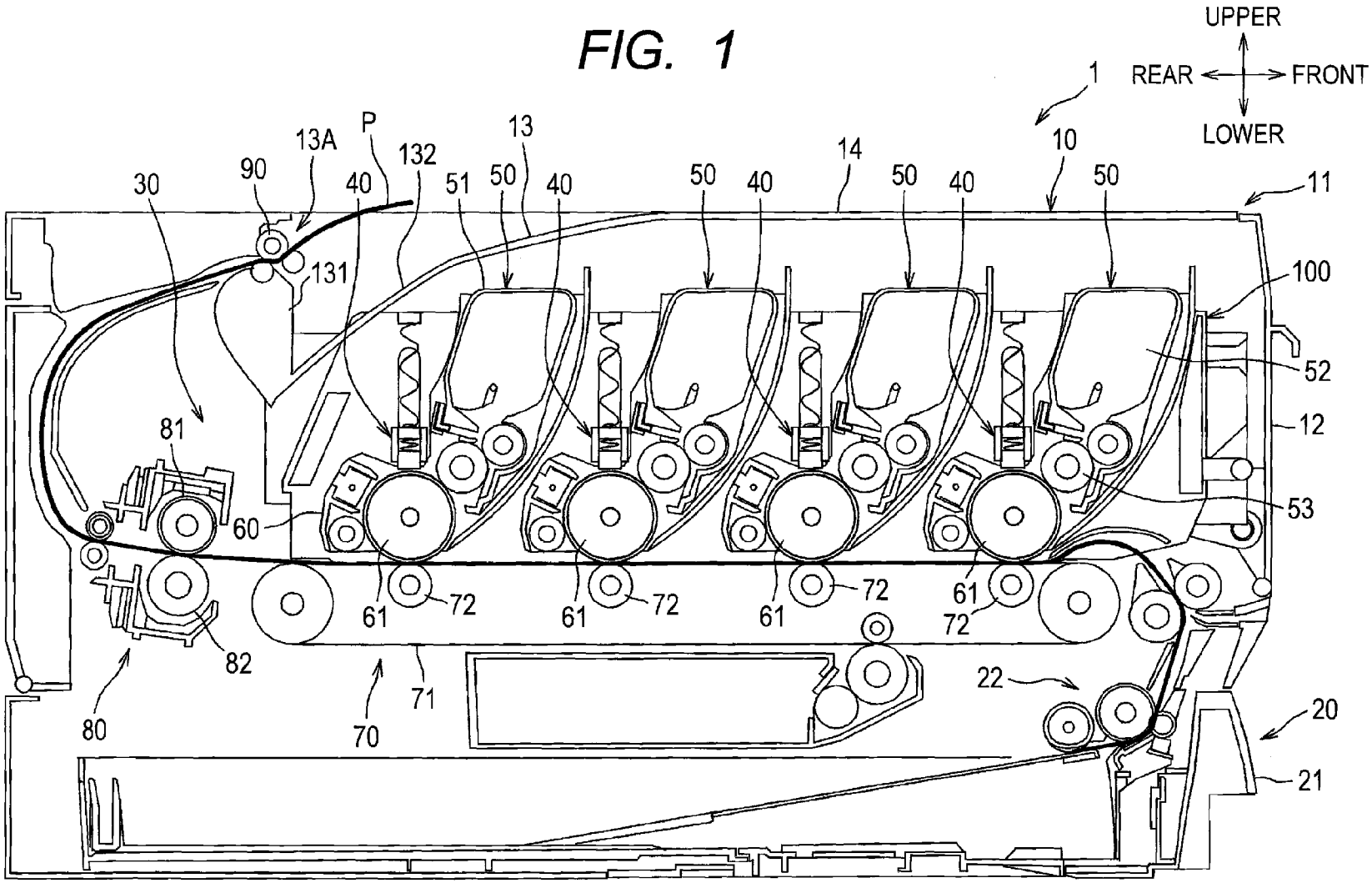
FIG. 1 is a vertical cross-sectional view showing a color printer embodying an image forming apparatus according to a first embodiment of the invention.

A color printer embodying an image forming apparatus according to a first embodiment of the invention will be described while referring to FIGS. 1 through 6.

In the following description, the expressions "front", "rear", "upper", "lower", "right", and "left" are used to define the various parts when the color printer is disposed in an orientation in which it is intended to be used by a user. That is, in FIG. 1, the right side on the drawing sheet is defined as the "front" side, the left side on the drawing sheet is defined as the "rear" side, the far side in a direction perpendicular to the drawing sheet is defined as the "right" side, and the near side in the direction perpendicular to the drawing sheet is defined as the "left" side. Further, the upper and lower direction on the drawing sheet is defined as the "upper-lower direction". Also, in cross-sectional views, hatching is provided in especially necessary areas for simplicity.

As shown in FIG. 1, a color printer 1 includes, within an apparatus main body 10, a paper feeding section 20 that feeds paper P (recording sheet) and an image forming section 30 that forms an image by superposing images corresponding to respective colors of K (black), C (cyan), M (magenta), Y (yellow) on fed paper P.

An opening 11 (see FIG. 3) is formed at a front wall of the apparatus main body 10. A front cover 12 is also provided pivotally at the front wall so as to open and close the opening 11. Specifically, the front cover 12 is pivotally movable (displaceable) between a closed position (the position shown in FIG. 1) at which the opening 11 is closed and an open position (the position shown in FIG. 3) at which the opening 11 is opened.

The paper feeding section 20 includes a paper feeding tray 21 that accommodates paper P and a paper conveying device 22 that conveys paper P from the paper feeding tray 21 to the image forming section 30.

The image forming section 30 includes four LED arrays 40 (an example of a plurality of exposing members), four process cartridges 50, a transfer unit 70, and a fixing unit 80.

Each LED array 40 includes a semiconductor chip and a plurality of LEDs so as to expose a corresponding one of photosensitive drums 61 described later to light along a main scanning direction (the axial direction of the photosensitive drum 61). The four LED arrays 40 for respective colors are arranged above and adjacent to the respective photosensitive drums 61 so as to correspond to the four photosensitive drums 61 for the respective colors, and are supported by a drawer 100 described later (an example of a photosensitive-drum supporting member).

The process cartridges 50 are arranged in the front-rear direction. Each of the process cartridges 50 includes a developing cartridge 51 and a drum cartridge 60 disposed below the developing cartridge 51, and is detachably mounted on the drawer 100.

Each of the developing cartridges 51 includes a toner accommodating container 52 that accommodates toner (an example of developer), a developing roller 53 that supplies toner within the toner accommodating container 52 to the photosensitive drum 61, a supply roller and a layer-thickness regulating blade (both shown in the drawing, but reference signs are omitted), and the like. Four developing cartridges 51 accommodate therein toner in the respective colors and are arranged adjacent to and diagonally forward above the respective photosensitive drums 61 so as to correspond to the four photosensitive drums 61. The developing cartridge 51 is detachably mounted on the drum cartridge 60.

Each drum cartridge 60 includes the photosensitive drum 61, a well-known charger (shown in the drawing, but reference signs are omitted), and the like. The four drum cartridges 60 are detachably mounted on the drawer 100 described later.

The transfer unit 70 is provided between the paper feeding section 20 and the photosensitive drums 61. The transfer unit 70 includes an endless conveying belt 71 looped around a plurality of rollers, and four transfer rollers 72. The conveying belt 71 is disposed below the photosensitive drums 61 so as to confront the plurality of photosensitive drums 61. The transfer rollers 72 are arranged inside the conveying belt 71 so as to sandwich the conveying belt 71 with the respective photosensitive drums 61.

The fixing unit 80 is disposed at the rear side of the process cartridges 50 and the transfer unit 70. The fixing unit 80 includes a heat roller 81 and a pressure roller 82 arranged to confront the heat roller 81 for pressing the heat roller 81.

In the image forming section 30 having the above-described configuration, first, a surface of each photosensitive drum 61 is charged uniformly by the charger, and is then exposed to light by the LED array 40. With this operation, an electric potential of exposed portions decreases, and an electrostatic latent image is formed on each photosensitive drum 61 based on image data. Subsequently, toner is supplied to the electrostatic latent image from the developing roller so that a toner image is borne on the photosensitive drum 61.

Next, the paper P conveyed onto the conveying belt 71 passes between the photosensitive drums 61 and the respective transfer rollers 72, so that the toner image formed on each photosensitive drum 61 is transferred onto the paper P. Then, the paper P passes between the heat roller 81 and the pressure roller 82, and the toner image transferred onto the paper P is thermally fixed onto the paper P.

Then, the paper P subjected to thermal fixing by the fixing unit 80 is discharged outside of the apparatus main body 10 by discharge rollers 90 arranged at the downstream side of the fixing unit 80, and is placed on a discharge tray section 13 formed at an upper wall 14 of the apparatus main body 10. Here, the discharge tray section 13 is formed to be concave downward at a center part of the upper wall 14 of the apparatus main body 10 in the left-right direction, so that spaces are formed in the apparatus main body 10 at the left and right sides (the both axial ends of the photosensitive drum 61) of the discharge tray section 13.

Specifically, the discharge tray section 13 includes a first wall 131 and a second wall 132. The first wall 131 extends downward and perpendicularly from the upper wall 14 of the apparatus main body 10, and has a discharge opening 13A of paper P. The second wall 132 extends in a diagonally front upper direction from the lower end of the first wall 131 toward the upper wall 14, and has an arc shape that is convex upward in cross-section.

<Structure of Drawer 100 and Surrounding Parts>

Next, the structure of the drawer 100 and surrounding parts will be described in detail.

Figure 2:
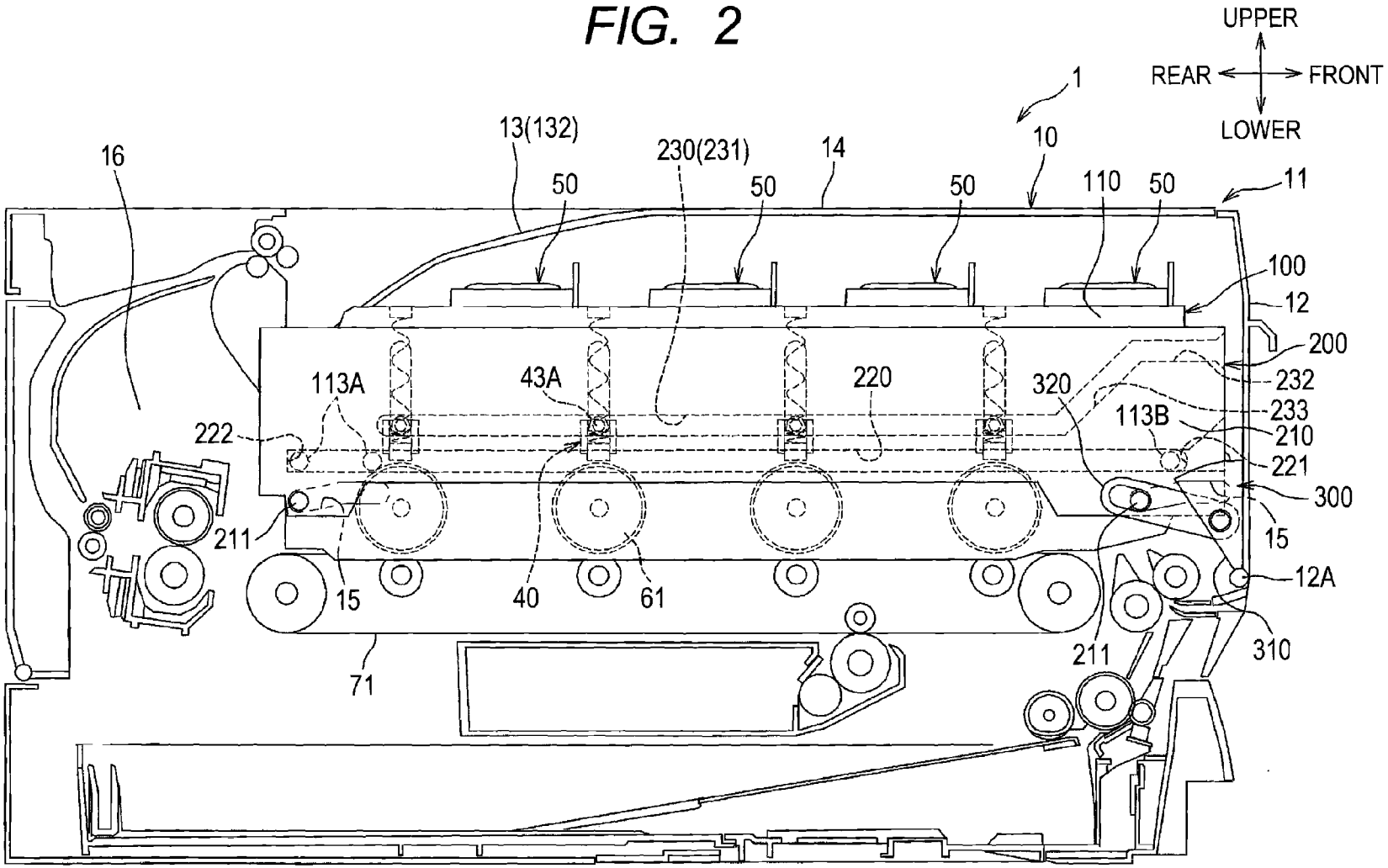
FIG. 2 is a vertical cross-sectional view showing a drawer and a guide member in a state where a front cover is at a closed position.
Figure 3:
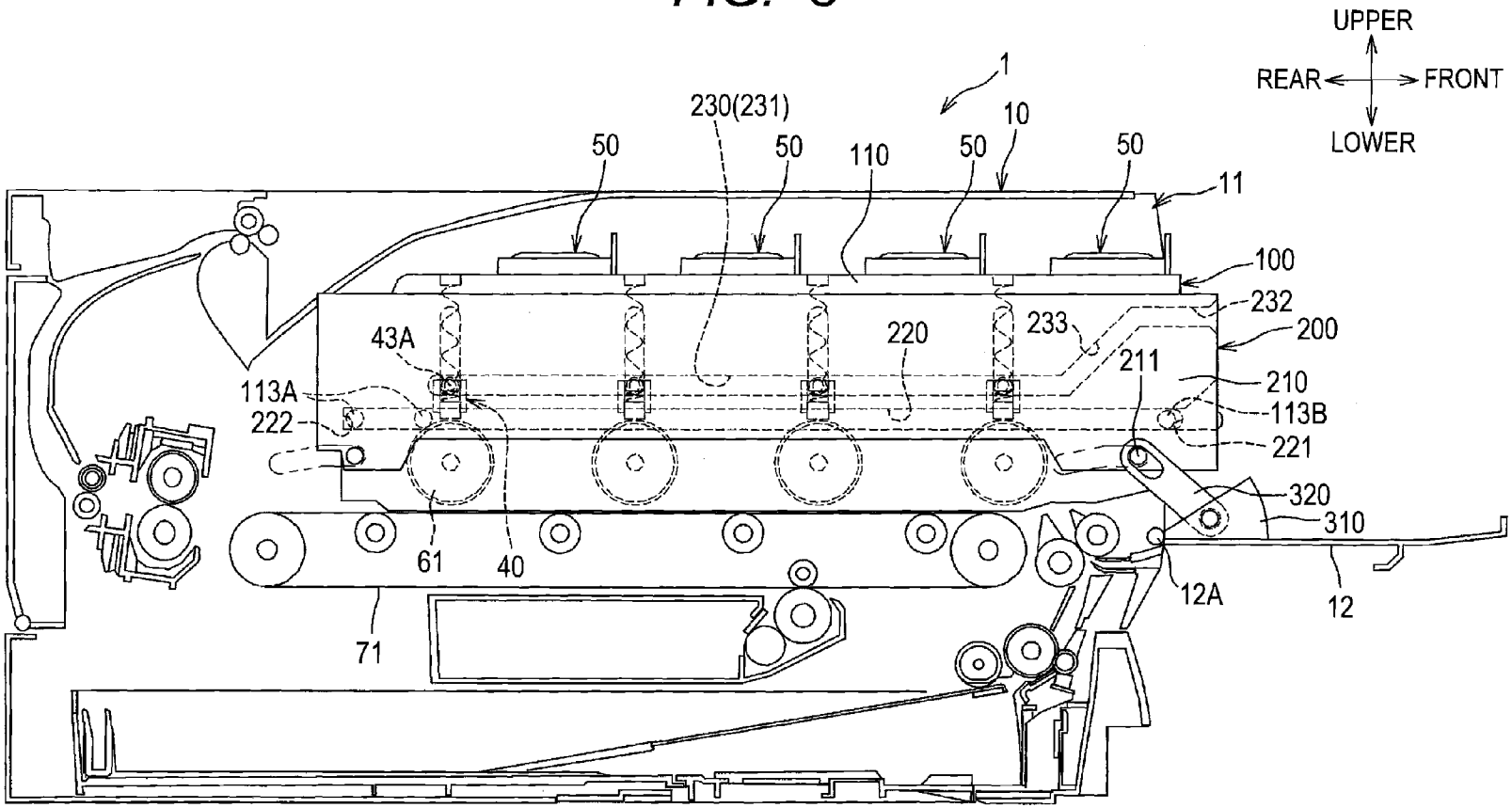
FIG. 3 is a vertical cross-sectional view showing the drawer and the guide member in a state where a front cover is at an open position.
Figure 4:
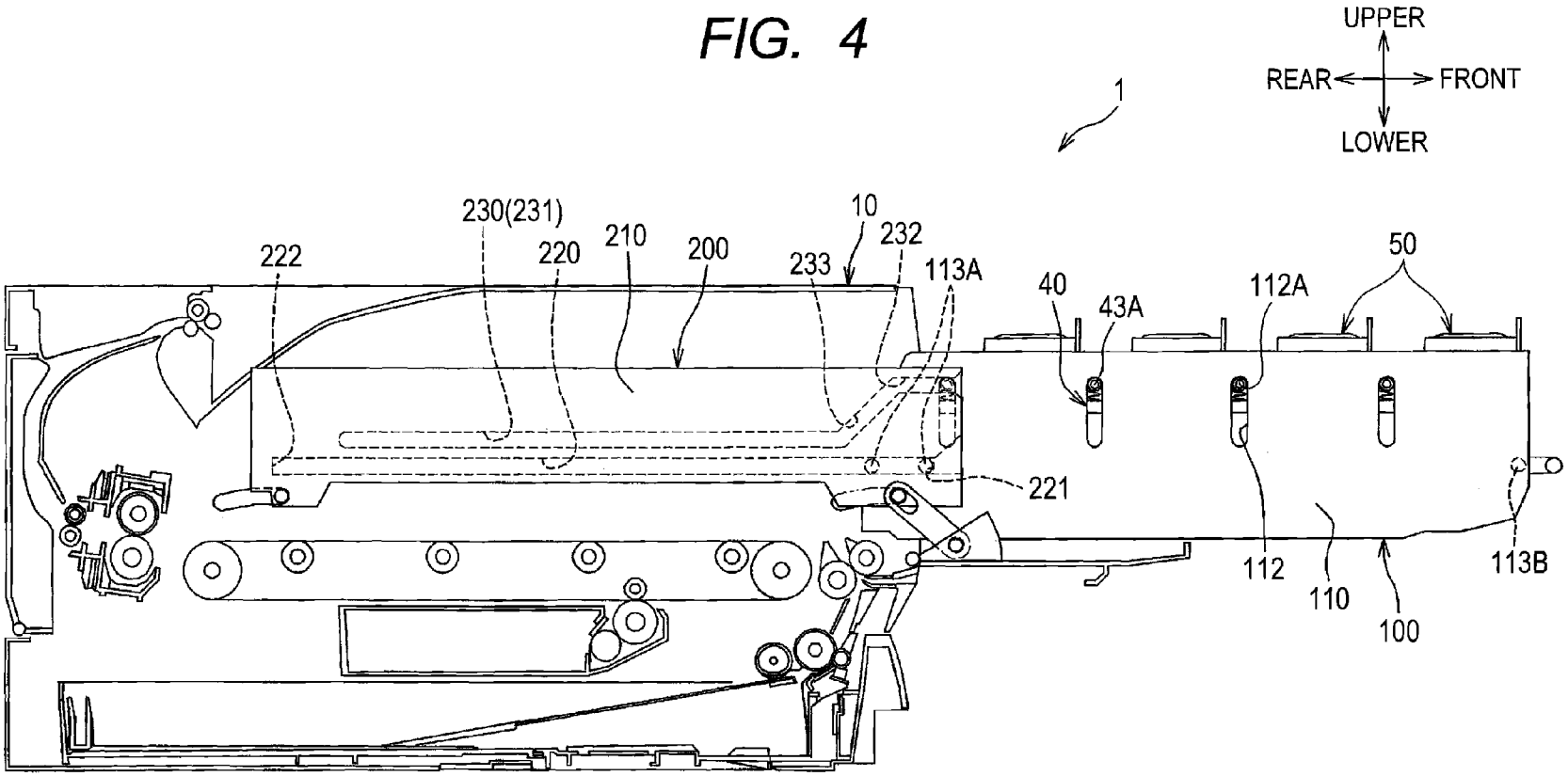
FIG. 4 is a vertical cross-sectional view showing a state in which the drawer is pulled out to outside an apparatus main body.

As shown in FIGS. 2 through 4, the drawer 100 is movable in the front-rear direction between: a stowed position at which the drawer 100 is stowed within the apparatus main body 10 (the position shown in FIG. 3); and a moved position at which the drawer 100 is moved to outside the apparatus main body 10 from the stowed position through the opening 11 of the apparatus main body 10 (the position shown in FIG. 4). In other words, the drawer 100 can be pulled out in a direction in which paper P is discharged in the discharge tray section 13 (that is, in the forward direction).

Specifically, the drawer 100 moves upward when the front cover 12 is opened and is configured to be pulled out forward through the opening 11 from the position moved upward. That is, the drawer 100 is movable in the vertical direction (the optical axis direction of the LED array 40), and is also movable in the front-rear direction (the direction in which the plurality of photosensitive drums 61 is arranged).

Each LED array 40 within the drawer 100 moves upward and downward in conjunction with forward and rearward movement of the drawer 100. More specifically, each LED array 40 is disposed at an exposing position adjacent to the photosensitive drum 61 (the position shown in FIG. 3) when the drawer 100 is located at the stowed position, and is disposed at a retracted position at which the LED array 40 is retracted (separated) from the photosensitive drum 61 and is engaged by an engaging part 112A (an upper edge of an elongated hole 112 described later) (the position shown in FIG. 4) when the drawer 100 is located at the moved position.

Each LED array 40 is accommodated within the drawer 100 both at the exposing position and at the retracted position. That is, each LED array 40 does not protrude from the drawer 100 at the exposing position or at the retracted position. With this configuration, each LED array 40 can be protected from a user and the like.

Specifically, the drawer 100, a left and right pair of guide members 200 (an example of an action member), and a left and right pair of interlocking mechanisms 300 are provided at the apparatus main body 10.

The pair of guide members 200 supports the drawer 100 such that the drawer 100 is configured to move linearly in the front-rear direction. The pair of interlocking mechanisms 300 moves the guide members 200 in a diagonally front upper direction or in a diagonally rear lower direction in conjunction with an open/close operation of the front cover 12.

Note that members arranged at the left and right sides, such as the guide members 200 and the interlocking mechanisms 300, have bilaterally symmetrical structures. Thus, in the following descriptions, a structure at either one of the left and right sides will be described, and descriptions of a structure at the other side will be omitted.

Figure 5:
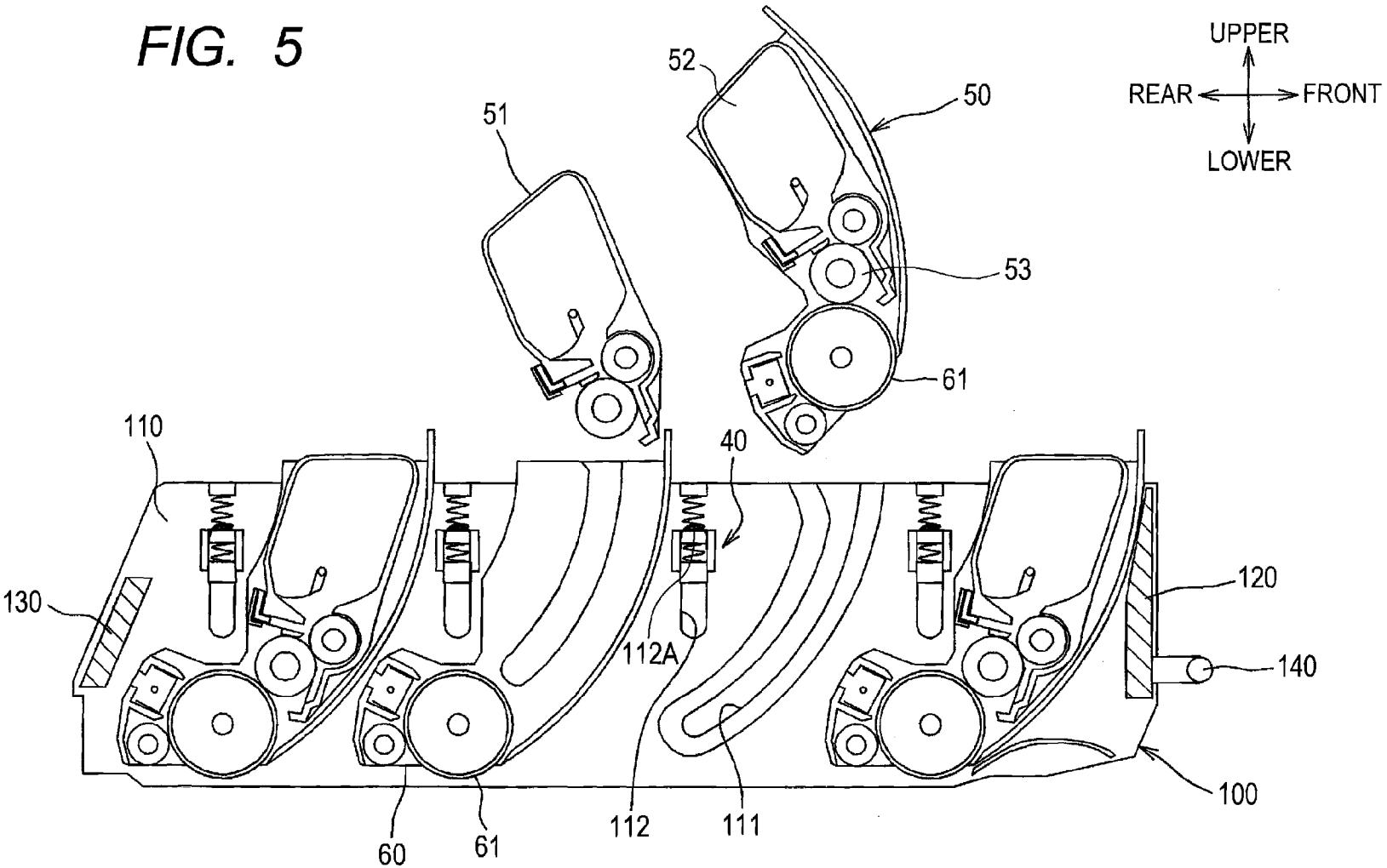
FIG. 5 is a vertical cross-sectional view showing a relationship between the drawer and process cartridges.

The drawer 100 has a pair of side walls 110 confronting each other in the left-right direction (the axial direction of the photosensitive drum 61), and supports the plurality of process cartridges 50 (the plurality of photosensitive drums 61) and the plurality of LED arrays 40 between the pair of side walls 110. Further, as shown in FIG. 5, the front end parts of the pair of side walls 110 are connected by a front wall 120, whereas the rear end parts of the pair of side walls 110 are connected by a rear wall 130. A handle section 140 gripped by a user and having a U-shape in cross-section is provided at the front surface of the front wall 120.

Arc-like grooves 111 is formed on the inner surface of each side wall 110 for guiding the process cartridges 50 to respective exposed positions (the positions at which the photosensitive drums 61 are exposed to light by the LED arrays 40). With this configuration, each process cartridge 50 is configured to be moved in an arc shape relative to the drawer 100 and mounted on or dismounted from the drawer 100. Because the LED array 40 is disposed directly above the photosensitive drum 61 (FIG. 5), the space can be used efficiently by mounting and dismounting the process cartridge 50 in an arc shape along the arc-like groove 111 as described above.

The pairs of elongated holes 112 (an example of a penetration section) are formed in the side walls 110 for supporting each LED array 40 such that the LED array 40 is configured to move vertically. Each elongated hole 112 is formed to extend vertically, and engages an action receiving section 43A described later (see FIG. 6) of the LED array 40 in order to guide the LED array 40 between the exposing position and the retracted position.

Figure 6:
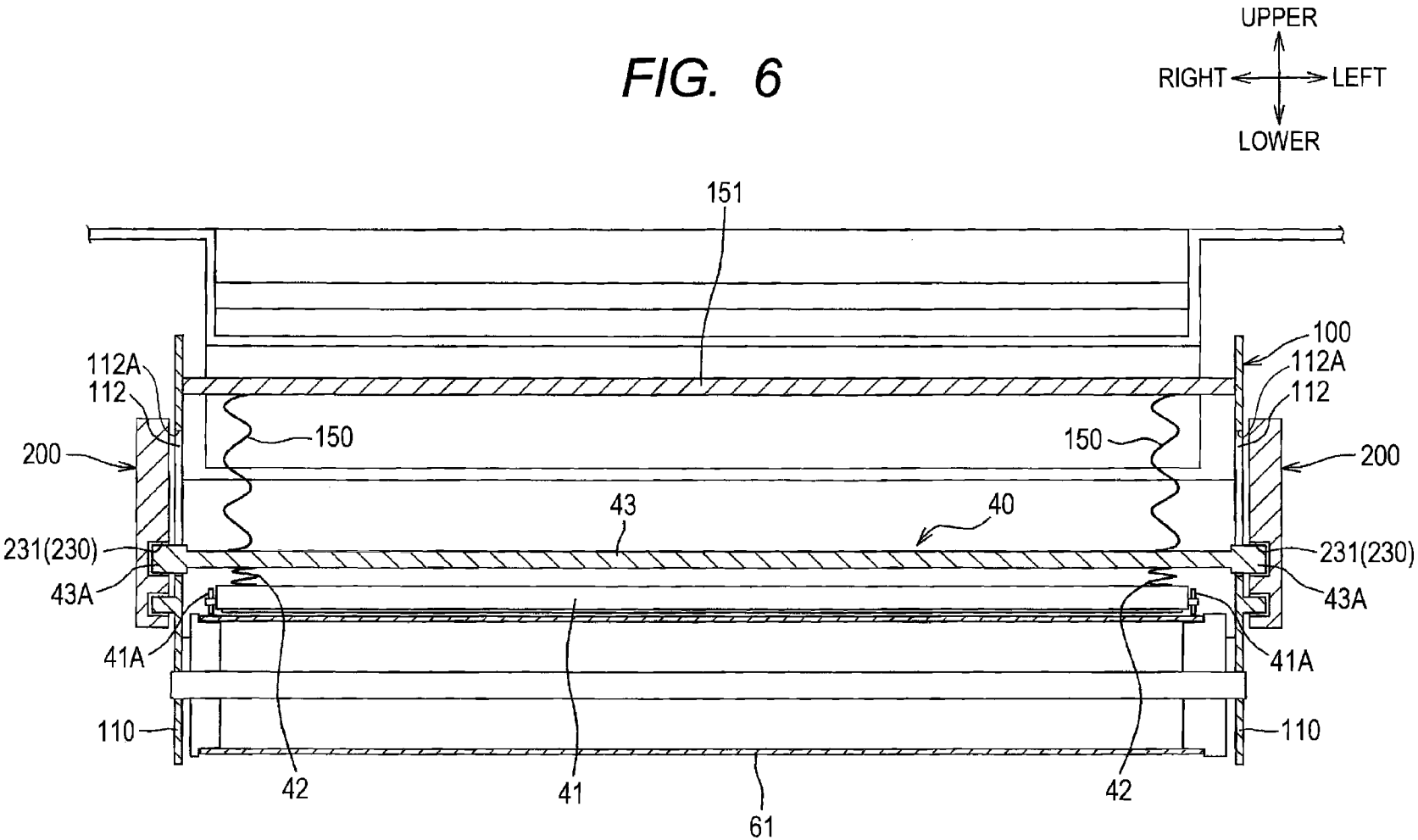
FIG. 6 is a vertical cross-sectional view of an LED array as viewed from the rear.

As shown in FIG. 6, the LED array 40 includes an LED head 41 having a plurality of LEDs, a pair of coil springs 42 that urges the LED head 41 toward the photosensitive drum 61, and a support frame 43 that supports the LED head 41 via the coil springs 42. The support frame 43 has an elongated shape in the left-right direction. The pair of action receiving section 43A is provided at the both ends of the support frame 43. The action receiving section 43A penetrate the respective elongated holes 112 and protrude outward from the respective side walls 110 in the left-right direction.

The support frame 43 is supported by the drawer 100 via tension coil springs 150 (an example of an urging member). Specifically, the tension coil springs 150 are arranged between a support wall 151 and the support frame 43 so as to constantly urge the LED array 40 in a direction away from the photosensitive drum 61. Here, the support wall 151 is fixed to the pair of side walls 110 in a manner bridging the pair of side walls 110.

As shown in FIGS. 2 through 4, each action receiving section 43A protruding outward from each side wall 110 contacts the pair of guide members 200 provided outside each side wall 110, so that the action receiving section 43A is pressed upward and downward by the guide member 200. The guide members 200 are provided at the apparatus main body 10, and support the drawer 100 such that the drawer 100 is configured to move in the front-rear direction. In other words, the guide members 200 are relatively movable relative to the drawer 100.

Specifically, the guide member 200 includes a main body section 210 that has a plate shape elongated in the front-rear direction, a drawer guide groove 220 (an example of a support-member guide section), and a guide groove 230 (an example of a guide section).

The main body section 210 is disposed to face the side wall 110 of the drawer 100. A protruding pin 211 protruding outward in the left-right direction is provided at each of the front lower part and the rear lower part of the main body section 210. The pair of front-side protruding pins 211 is movably supported by a pair of arc-like grooves 15 formed at a front part of left and right side frames 16 of the apparatus main body 10. The pair of rear-side protruding pins 211 is also movably supported by another pair of arc-like grooves 15 formed at a rear part of the left and right side frames 16.

With this configuration, the main body section 210 is movable between the position shown in FIG. 2 and the position shown in FIG. 3. More specifically, the main body section 210 is movably supported by the apparatus main body 10, such that the photosensitive drum 61 can move between: a contact position at which the photosensitive drum 61 is in contact with the conveying belt 71; and a separated position at which the photosensitive drum 61 is separated (spaced away) from the conveying belt 71. That is, in the present embodiment, the guide members 200 and the grooves 15 formed in the apparatus main body 10 serve as a separating mechanism that supports the drawer 100 via the guide members 200 such that the drawer 100 is configured to move at least vertically (upward and downward).

The drawer guide groove 220 is a groove that is formed in the front-rear direction, and that supports the drawer 100 such that the drawer 100 is configured to move in the front-rear direction. Specifically, the drawer guide groove 220 supports a pair of engaging pins (protrusions) 113A and one engaging pin (protrusion) 113B. The pair of engaging pins 113A is provided at the rear side of each side wall 110 of the drawer 100. The engaging pin 113B is provided at the front side of each side wall 110.

The drawer guide groove 220 is provided with a pair of restricting surfaces 221 and 222 that restricts movement of the pair of engaging pins 113A in the front-rear direction. With this configuration, forward and rearward movement of the drawer 100 relative to the guide member 200 is restricted, so that the drawer 100 is positioned at the stowed position and at the moved position.

Note that the engaging pin 113B provided at the front side of the side wall 110 of the drawer 100 is shorter than each of the pair of engaging pins 113A, so that the engaging pin 113B does not engage the restricting surface 221. That is, the engaging pin 113B is configured not to engage the restricting surface 221 and not to drop off the drawer guide groove 220.

The guide groove 230 is a groove for guiding the action receiving section 43A from the retracted position to the exposing position at a mounting operation of the drawer 100. The guide groove 230 has a closed rear end and a front end that opens to outside. Specifically, the guide groove 230 has a engaging section 231, an allowing section 232, and a slope section 233 (sloped groove). The engaging section 231 engages the action receiving section 43A when the LED array 40 is located at the exposing position. The allowing section 232 allows movement of the action receiving section 43A in the front-rear direction when the LED array 40 is located at the retracted position. The slope section 233 connects the engaging section 231 with the allowing section 232.

The engaging section 231 is formed as an elongated groove extending in the front-rear direction. An upper edge of the engaging section 231 restricts upward movement of the action receiving section 43A. Specifically, when the LED array 40 is located at the exposing position (a position at which guide rollers 41A provided rotatably at the LED head 41 are in contact with the photosensitive drum 61 as shown in FIG. 6), the LED head 41 is urged downward by the coil springs 42, and the action receiving sections 43A are urged upward by the coil springs 42 and the tension coil springs 150. Because the action receiving section 43A engages the upper edge of the engaging section 231, the LED array 40 is positioned at the exposing position, and is also urged toward the photosensitive drum 61 at appropriate urging force.

The allowing section 232 is formed as an elongated groove extending in the front-rear direction.

The slope section 233 is formed as an elongated groove that is inclined downward toward the rear. With this configuration, as the drawer 100 is mounted onto the guide members 200 (the apparatus main body 10), the action receiving section 43A is pressed downward by the upper edge of the slope section 233, and the LED array 40 moves downward to the exposing position. Further, as the drawer 100 is pulled out of the guide members 200 (the apparatus main body 10), the action receiving section 43A is pressed upward by the lower edge of the slope section 233 or is urged upward by the urging force of the tension coil spring 150, and the LED array 40 moves upward to the retracted position.

By moving the guide members 200 in conjunction with an open/close operation of the front cover 12, the interlocking mechanisms 300 displaces the guide members 200 (the photosensitive drums 61) from the contact position to the separated position when the front cover 12 is displaced from a closed position to an open position. Specifically, the interlocking mechanism 300 includes a fan-shape member 310 fixed to the front cover 12, and a link member 320 linking the guide member 200 with the fan-shape member 310.

The fan-shape member 310 has a fan shape of which the center is a swing shaft 12A of the front cover 12. A pair of the fan-shape members 310 is provided at the left and right sides of the lower end part of the front cover 12, respectively.

The first link member 320 has one end that is pivotally coupled to the front-side protruding pin 211 of the guide member 200 and another end that is pivotally coupled to the fan-shape member 310.

With this configuration, as the front cover 12 is opened, the guide member 200 is pulled forward by the front cover 12 via the link member 320 and the fan-shape member 310, so that the guide member 200 moves in a diagonally front upper direction along the arc-like groove 15. Further, as the front cover 12 is closed, the guide member 200 is pushed rearward by the front cover 12 via the link member 320 and the fan-shape member 310, so that the guide member 200 moves in a diagonally rear lower direction along the arc-like groove 15.

Further, the rear part of the drawer 100 and the rear part of the guide member 200 are arranged in the spaces formed at the left and right sides of the discharge tray section 13. More specifically, the rear part of the drawer 100 and the rear part of the guide member 200 are arranged at positions that overlap the discharge tray section 13 as viewed from the left-right direction in a state where the front cover 12 is closed and printing can be performed.

With this configuration, the position of the upper wall 14 of the apparatus main body 10 can be lowered without changing depth of the discharge tray section 13, thereby enabling the apparatus main body 10 to be downsized in the vertical direction. Further, by arranging a part of the drawer 100 and the like in the spaces formed at the left and right sides of the discharge tray section 13 in this way, the front upper part of the drawer 100 (the upper part of the process cartridges 50) and the front upper part of the guide members 200 are arranged in a space below the second wall 132 of the discharge tray section 13 and the upper wall 14. Thus, the space below the second wall 132 of the discharge tray section 13 and the upper wall 14 can be utilized efficiently.

According to the present embodiment, the following effects can be obtained.

The LED arrays 40 are accommodated within the drawer 100 both at the exposing position and at the retracted position. This configuration suppresses interference between the LED arrays 40 and other members, and can prevent the user from touching the LED array 40 by mistake.

The guide members 200 for vertically moving the LED arrays 40 are provided at the outside of the pair of side walls 110. Thus, the structure can be simplified, compared with the configuration where a linear-movement cam for vertically moving the LED arrays 40 is provided at the inside of the side walls.

The elongated holes 112 allowing penetration of the action receiving section 43A and engaging the action receiving section 43A are formed in the side wall 110 for guiding the LED array 40 between the exposing position and the retracted position. Thus, the structure can be simplified, compared with the configuration where a hole from which an action receiving section protrudes and a member for guiding the action receiving section are provided separately.

A hole (the elongated hole 112) is adopted as a penetration part through which the action receiving section 43A penetrates. Here, the "hole" means an opening of which the circumference is closed. Thus, strength of the side wall 110 can be increased, for example, compared with the configuration where a penetration part opened to an edge of the side wall (i.e., a notch-like shape) is formed.

Because the guide members 200 are provided at the apparatus main body 10, the weight of the drawer 100 can be reduced, and the operability can be improved. Further, when the drawer 100 is pulled out to the moved position, the risk that the color printer 1 falls toward the front side can be reduced.

Two grooves (the drawer guide groove 220 and the guide groove 230) are formed in one guide member 200. Thus, the structure can be simplified, for example, compared with the structure where each groove is formed in separate members.

The guide members 200 supporting the drawer 100 are moved vertically, enabling the drawer 100 to be pushed in and pulled out straightly and linearly in parallel with the belt surface of the conveying belt 71. Thus, the operability of the drawer 100 can be improved, for example, compared with the structure where the drawer is lifted diagonally upward and pulled out.

The front cover 12 and the guide members 200 are operated in an interlocking manner. Thus, mounting and dismounting operations of the drawer 100 can be performed more easily, for example, compared with the structure where the front cover 12 is opened and then the guide members 200 are moved vertically by hand.

The tension coil springs 150 are provided at the drawer 100 for urging the LED array 40 away from the photosensitive drum 61. Thus, when the drawer 100 is dismounted from the apparatus main body 10, the LED array 40 can be reliably moved to the retracted position with the urging force of the tension coil springs 150.

Second Embodiment

A color printer embodying an image forming apparatus according to a second embodiment of the invention will be described while referring to FIGS. 7 through 13, wherein like parts and components are designated by the same reference numerals to avoid duplicating description.

As shown in FIGS. 7 through 10, a color printer of the second embodiment includes a linear-movement cam 400 and a fixed guide member 500 provided at the apparatus main body 1, instead of the guide member 200 and the interlocking mechanism 300 in the first embodiment. The linear-movement cam 400 (an example of an action member) vertically moves the LED array 40 between the exposing position and the retracted position. The fixed guide member 500 supports the drawer 100 such that the drawer 100 is configured to move in the front-rear direction.

The linear-movement cam 400 is configured to move in the front-rear direction (the moving direction of the drawer 100). The linear-movement cam 400 mainly includes a main body section 410 having a plate shape elongated in the front-rear direction, four cam grooves 420 (an example of a guide section) formed in the main body section 410 at predetermined intervals in the front-rear direction, and a rack gear section 430 provided at a front part of the lower end of the main body section 410.

The main body section 410 is arranged between the side wall 110 of the drawer 100 and the side frame 16 of the apparatus main body 10 at each of the left and right sides, such that the main body section 410 faces the side wall 110 and the side frame 16. The main body section 410 is supported by a plurality of support rollers 16A rotatably provided at the side frame 16, such that the main body section 410 is configured to move forward and rearward. Further, holding members (for example, L-shaped members supporting the upper and lower ends of the main body section 410; not shown) are provided at the side frame 16 for holding the main body section 410 in a state facing the side frame 16.

The four cam grooves 420 has an engaging section 421, an allowing section 422, and a slope section 423 having the same function as each section of the guide groove 230 in the first embodiment. Each of the cam grooves 420 is inclined downward toward the rear side. In addition, the cam groove 420 has a mount-dismount section 424 that extends from the allowing section 422 in a diagonally front upper direction and that opens at the upper end of the main body section 410.

Figure 9:
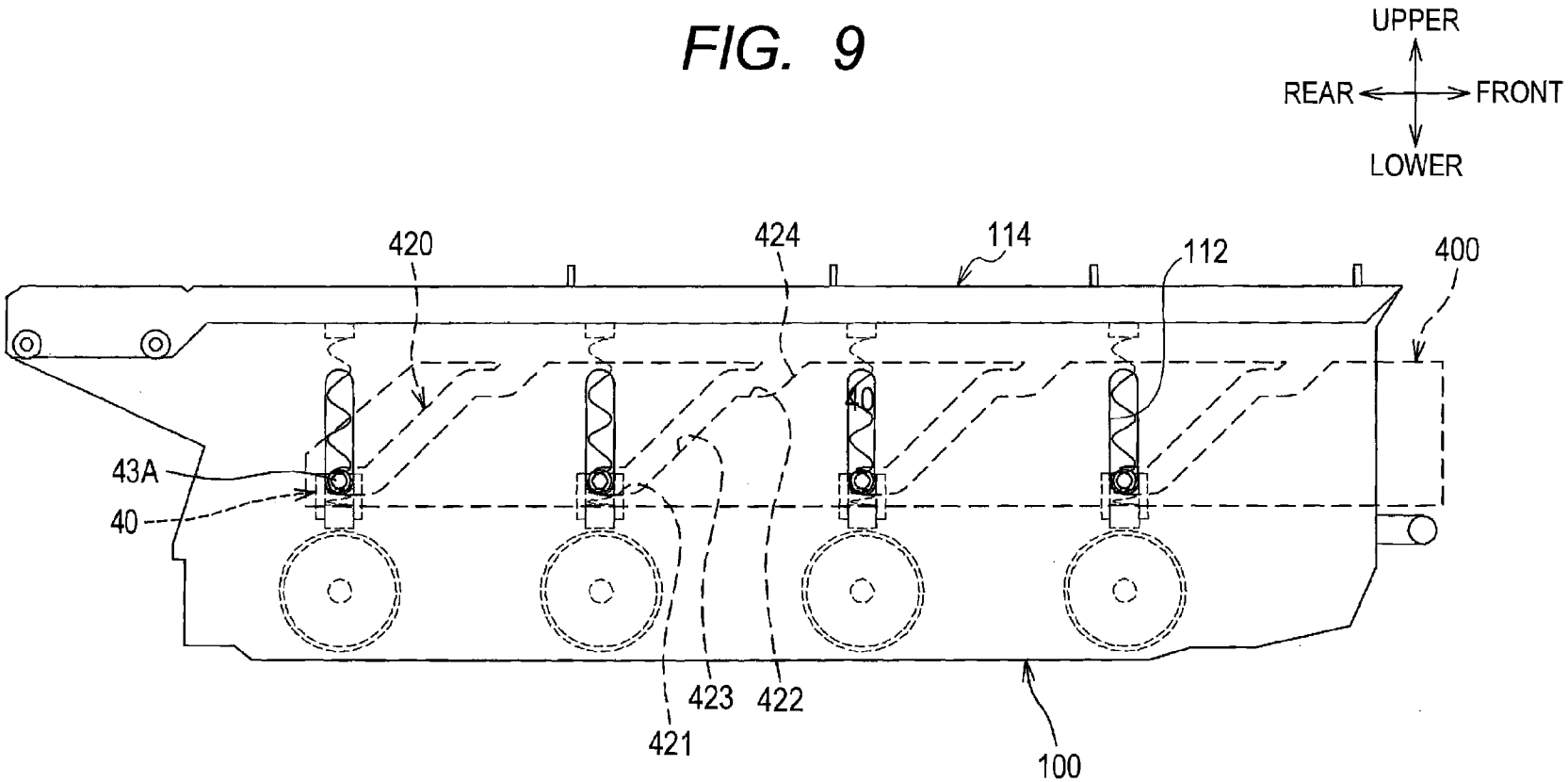
FIG. 9 is a side view showing a relationship between a linear-movement cam and the drawer in a state where the front cover is at the closed position.
Figure 10:
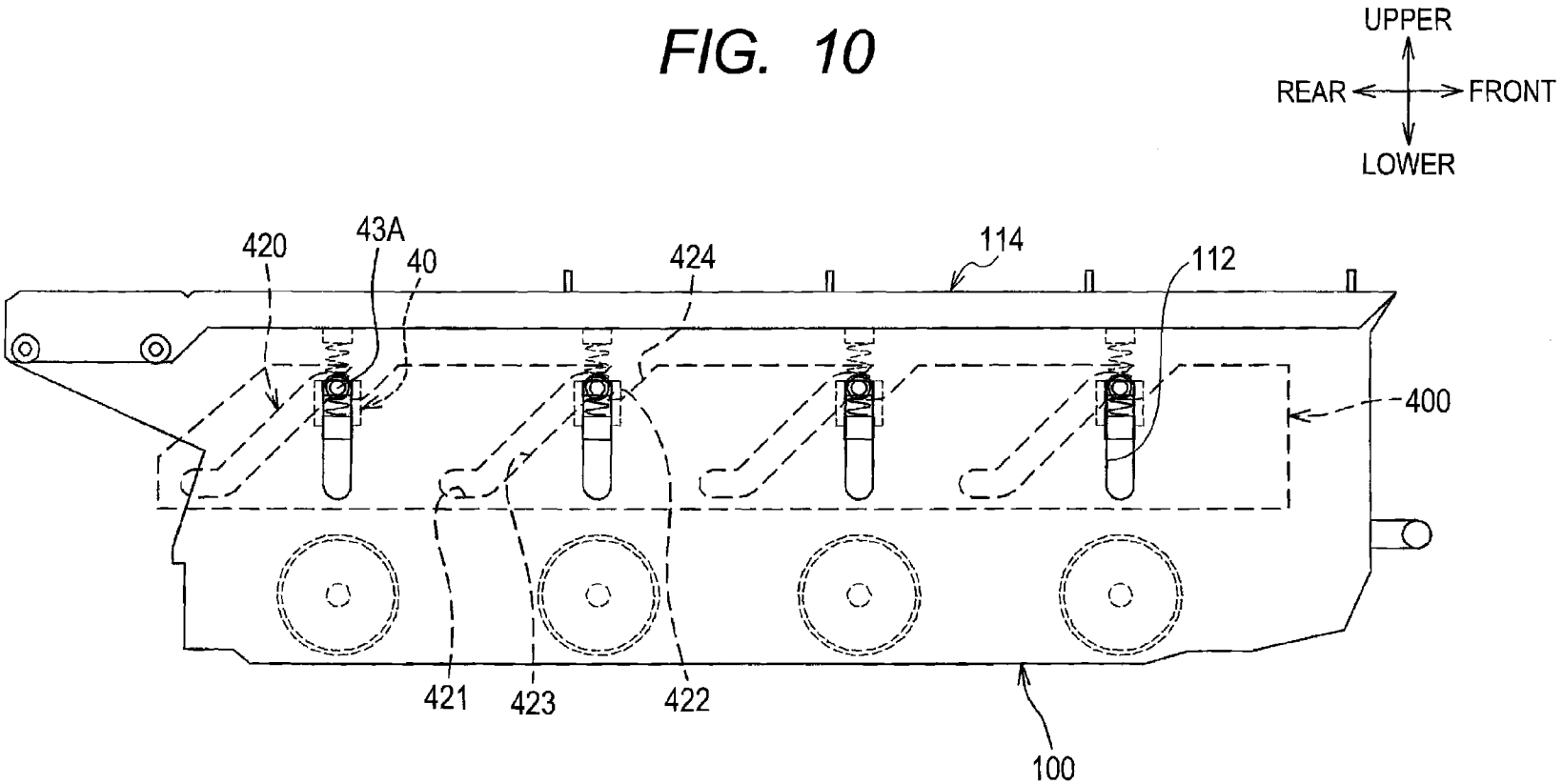
FIG. 10 is a side view showing a relationship between the linear-movement cam and the drawer in a state where the front cover is at the open position.

With this configuration, when the linear-movement cam 400 is moved forward from the position shown in FIG. 10, the action receiving section 43A is pushed downward by the upper edge of the slope section 423 and, as shown in FIG. 9, the LED arrays 40 move downward to the exposing position. On the other hand, when the linear-movement cam 400 is moved rearward from the position shown in FIG. 9, the action receiving section 43A is pushed upward by the lower edge of the slope section 423 or is urged upward by the urging force of the tension coil spring 150 and, as shown in FIG. 10, the LED arrays 40 move upward to the retracted position.

Further, when the drawer 100 is moved in a diagonally front upper direction at the position shown in FIG. 10, each action receiving section 43A passes the mount-dismount section 424 and gets out of the cam groove 420.

Figure 7:
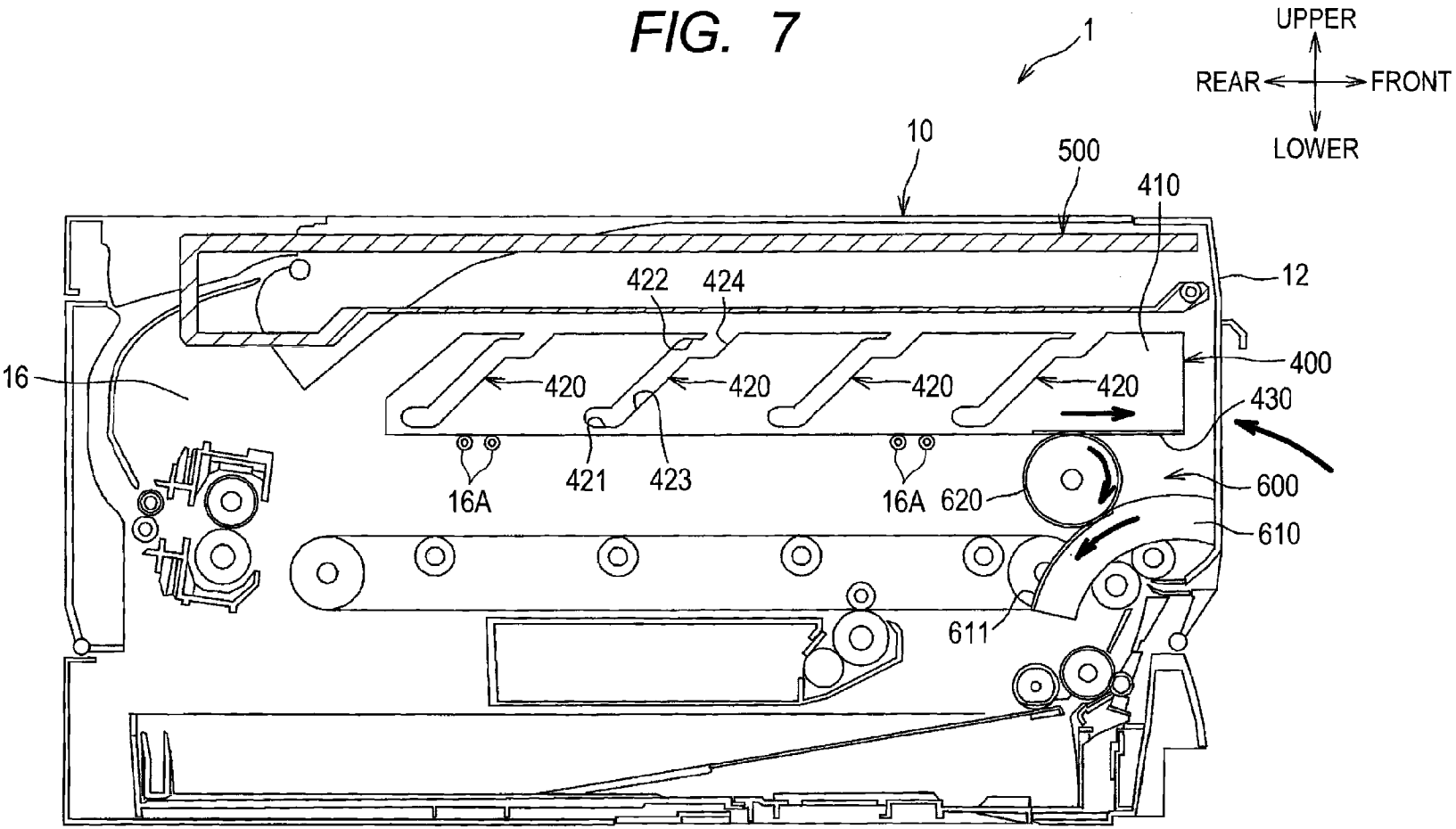
FIG. 7 is a vertical cross-sectional view showing a color printer embodying an image forming apparatus according to a second embodiment of the invention, in a state where a front cover is at a closed position.
Figure 8:
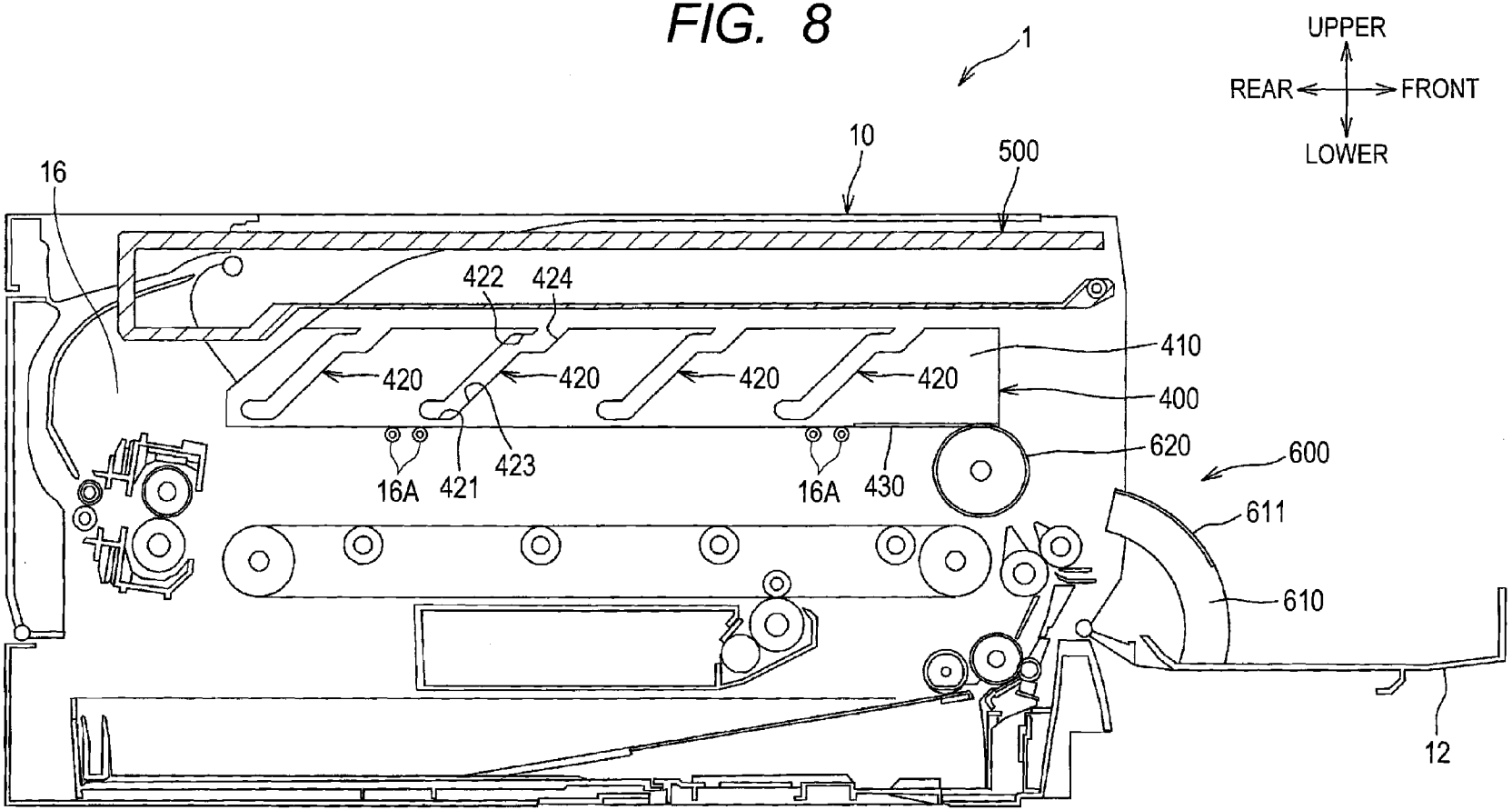
FIG. 8 is a vertical cross-sectional view showing the color printer of FIG. 7, in a state where a front cover is at an open position.

As shown in FIGS. 7 and 8, the rack gear section 430 includes a plurality of gear teeth arranged in the front-rear direction, so that force generated by an open/close operation of the front cover 12 is transmitted to the rack gear section 430 via an interlocking mechanism 600.

The interlocking mechanism 600 interlocks the linear-movement cam 400 with the front cover 12, such that the LED arrays 40 move from the exposing position to the retracted position when the front cover 12 is displaced from the closed position to the open position. Specifically, the interlocking mechanism 600 includes an arc-like gear member 610 and a gear 620. The arc-like gear member 610 is integrally provided on an inner surface of the front cover 12. The gear 620 is configured to meshingly engage the arc-like gear member 610 and the rack gear section 430.

The arc-like gear member 610 has an arc shape of which the center is the swing center of the front cover 12. A gear section 611 is provided at a part of the outer circumferential surface of the arc-like gear member 610 for meshingly engaging the gear 620. The gear 620 is rotatably provided at the side frame 16 of the apparatus main body 10.

Because the interlocking mechanism 600 is configured in this manner, when the front cover 12 is opened or closed, the force is transmitted to the rack gear section 430 via the arc-like gear member 610 and the gear 620, and the linear-movement cam 400 moves in the front-rear direction. More specifically, when the front cover 12 is closed, the action receiving section 43A moves rearward relative to the linear-movement cam 400 and moves along the cam groove 420 so that the LED array 40 moves downward to the exposing position. On the other hand, when the front cover 12 is opened, the action receiving section 43A moves forward relative to the linear-movement cam 400 and moves along the cam groove 420 so that the LED array 40 moves upward to the retracted position. Hence, the user only need to open or close the front cover 12 in order to move the LED arrays 40 upward or downward automatically. Thus, the operability of the drawer 100 can be improved compared with the structure where the LED arrays 40 are moved manually.

Figure 11:
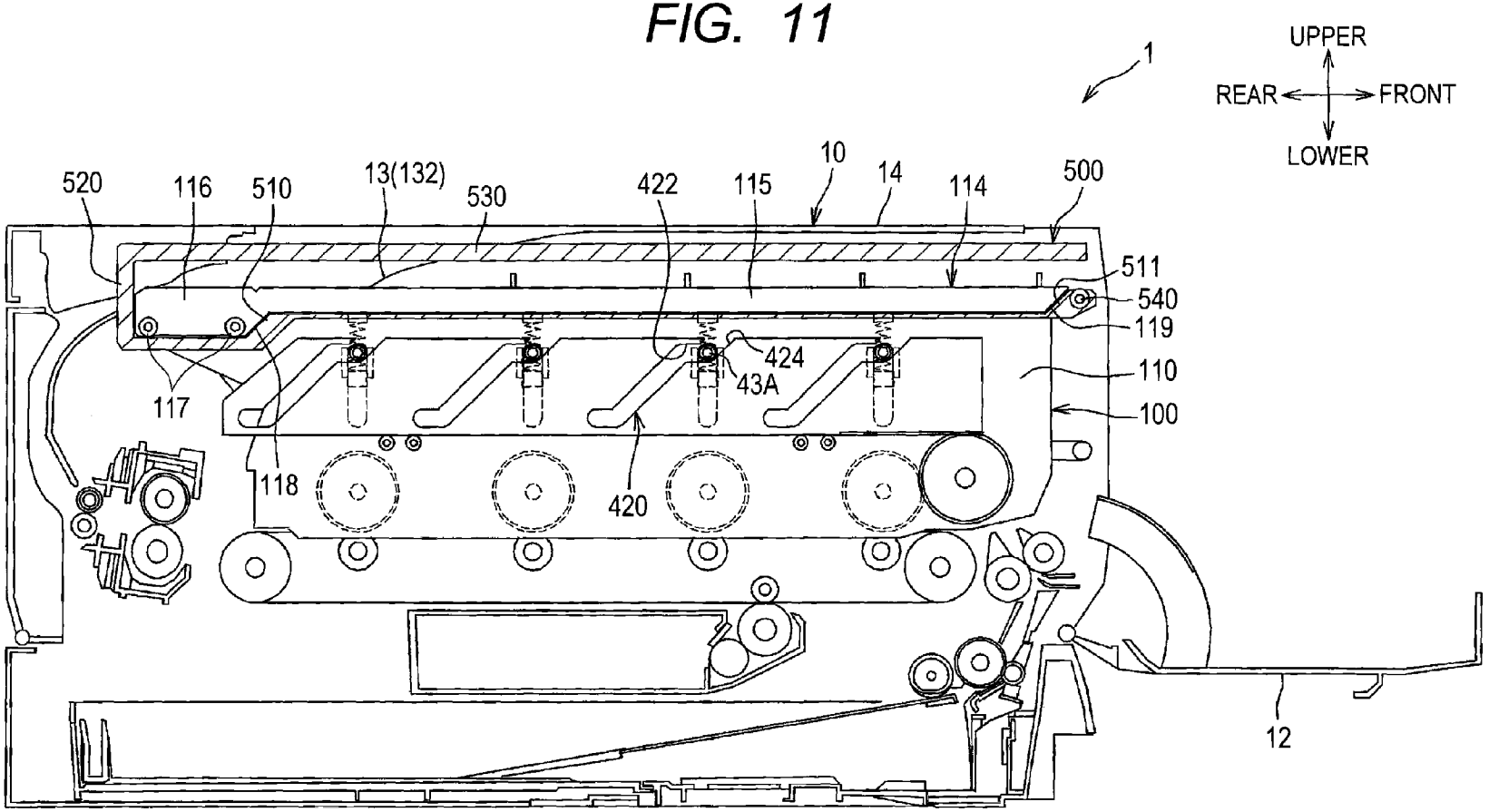
FIG. 11 is a vertical cross-sectional view showing a state in which the drawer is located at a stowed position.
Figure 12:
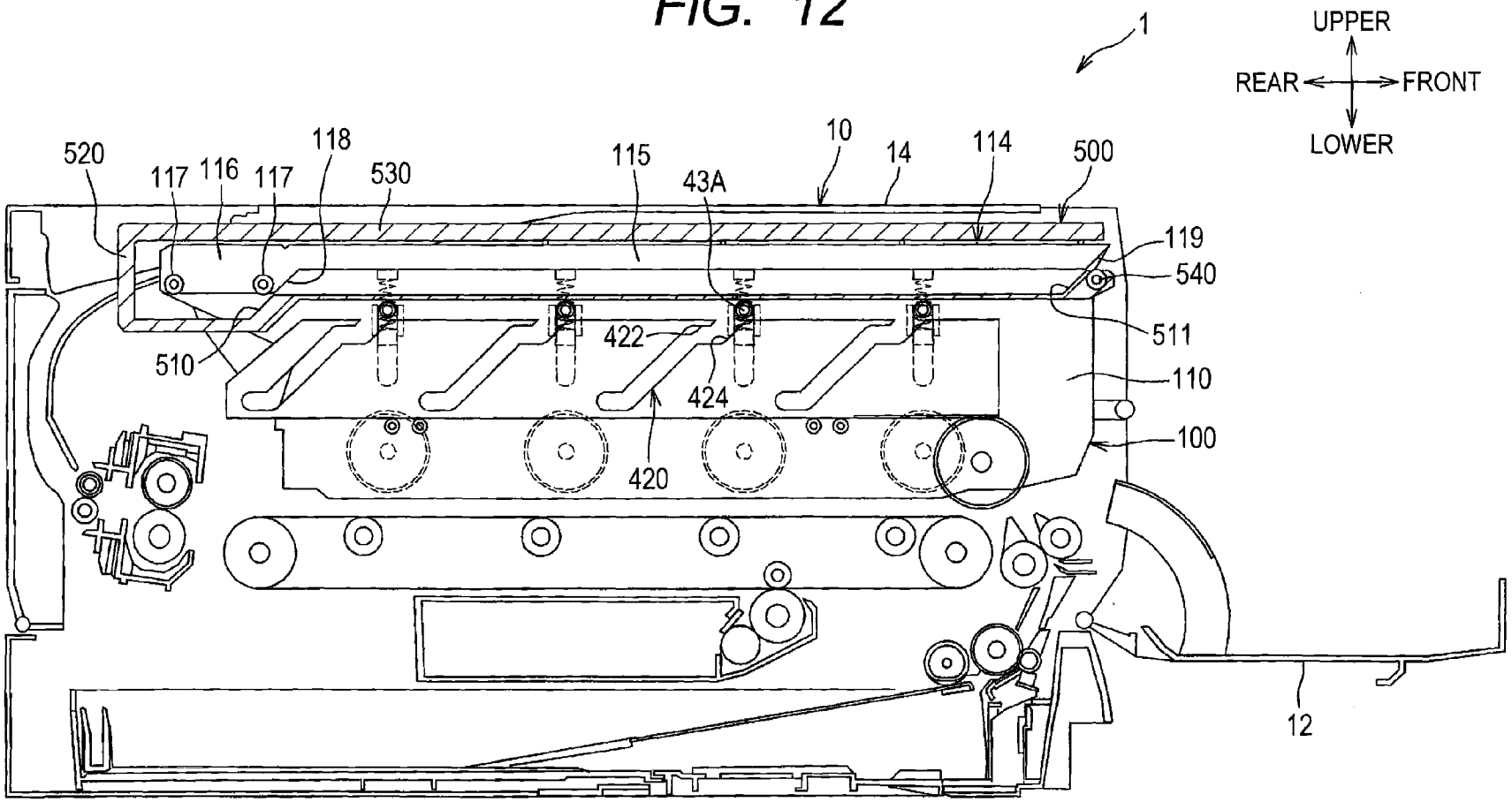
FIG. 12 is a vertical cross-sectional view showing a state in which the drawer is moved up in a diagonally front upper direction from the position shown in FIG. 11.
Figure 13:
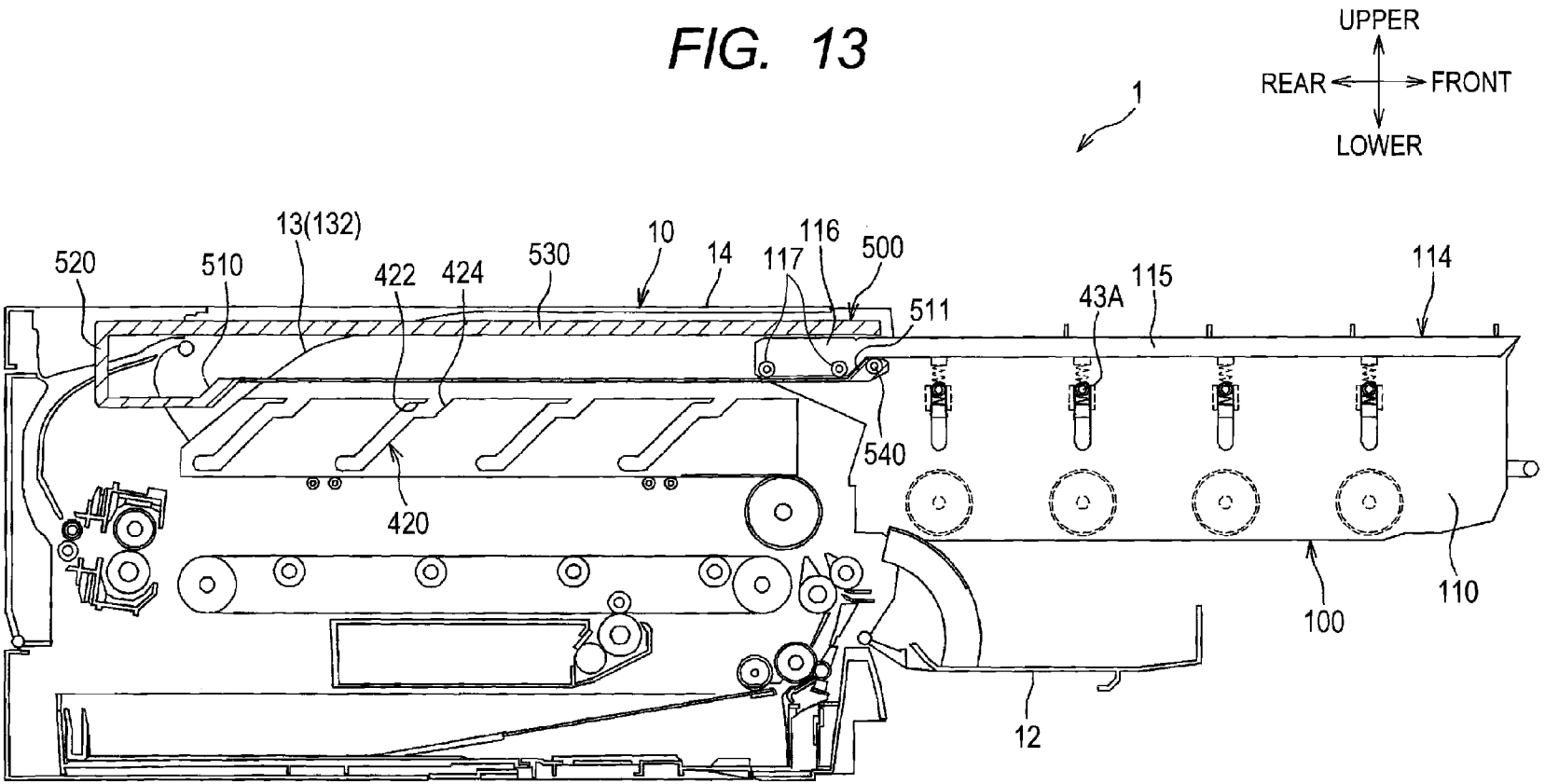
FIG. 13 is a vertical cross-sectional view showing a state in which the drawer is pulled out to a moved position.

As shown in FIGS. 11 through 13, a guided section 114 protruding outward in the left-right direction is provided at the upper end of each side wall 110 of the drawer 100. The guided section 114 is supported by the fixed guide member 500 such that the guided section 114 is configured to move forward and rearward. The guided section 114 includes an elongated section 115, a protruding section 116, and wheels 117. The elongated section 115 extends in the front-rear direction. The protruding section 116 is integrally provided at the rear end of the elongated section 115 and protrudes downward from the elongated section 115. The wheels 117 are rotatably provided at the protruding section 116.

A step surface 118 provided between the lower surface of the protruding section 116 and the lower surface of the elongated section 115 is a slope surface that is inclined in a diagonally front upper direction. A lower surface 119 at the front end of the elongated section 115 is also a slope surface that is inclined in a diagonally front upper direction. More specifically, the step surface 118 and the lower surface 119 are inclined at the same angle as the mount-dismount section 424 of the above-described cam groove 420.

On the other hand, the fixed guide member 500 includes a lower wall section 510, a rear wall section 520, an upper wall section 530, and a wheel 540. The lower wall section 510 has a shape that follows the shape of the lower surface of the guided section 114. The rear wall section 520 is configured to abut the rear end of the guided section 114 in order to position the drawer 100 at the stowed position. The upper wall section 530 faces the upper surface of the guided section 114. The wheel 540 is rotatably provided at the front end of the lower wall section 510.

The linear-movement cam 400, the fixed guide member 500, and the like have the above-described configurations. Thus, in order to pull the drawer 100 out of the apparatus main body 10, when the user opens the front cover 12, the linear-movement cam 400 moves rearward and the LED arrays 40 move to the retracted position. Next, when the user pulls the drawer 100, the wheels 117 get over the step of the lower wall section 510, and the front end of the guided section 114 gets over the wheel 540. With this operation, the drawer 100 moves in a diagonally front upper direction, so that each photosensitive drum 61 separates from the conveying belt 71 and also each action receiving section 43A gets out of the cam groove 420.

Subsequently, the wheels 117 of the guided section 114 rolls on the upper surface of the lower wall section 510 (the surface located at the front side of the step), and the elongated section 115 of the guided section 114 is supported by the wheel 540, thereby enabling the drawer 100 to be pulled out straight toward the front side. Then, when the protruding section 116 of the guided section 114 abuts a front end section 511 (a part protruding upward) of the lower wall section 510, the drawer 100 is stopped at that position (the moved position).

In order to bring the drawer 100 back to the stowed position, when the user pushes the drawer 100, the drawer 100 moves straight toward the rear side until the protruding section 116 of the guided section 114 reaches a concave portion at the rear end of the lower wall section 510 and, when the protruding section 116 reaches the concave portion, the drawer 100 moves in a diagonally rear lower direction. With this operation, when the protruding section 116 fits into the concave portion and abuts the rear wall section 520, the drawer 100 is stopped at that position (the stowed position), and the action receiving section 43A of each LED array 40 passes through the mount-dismount section 424 of the cam groove 420 and gets into the allowing section 422. Subsequently, when the user closes the front cover 12, the linear-movement cam 400 moves forward, and the LED arrays 40 move to the exposing position.

With the structure of the above-described second embodiment, because the LED arrays 40 can be moved upward and downward within the drawer 100, the effects similar to those in the first embodiment can be obtained.

In the second embodiment, the rear part of the fixed guide member 500, the rear part of the guided section 114 of the drawer 100 supported by that part, and the rear part of the linear-movement cam 400 are arranged in the spaces at the left and right sides of the discharge tray section 13. More specifically, the rear part of the fixed guide member 500 and the rear part of the drawer 100 are arranged at positions overlapping the discharge tray section 13 as viewed from the left-right direction in a state where the front cover 12 is closed and printing can be performed. Further, in a state where the front cover 12 is opened, the rear part of the linear-movement cam 400 is arranged at a position overlapping the discharge tray section 13 as viewed from the left-right direction.

With this configuration, the position of the upper wall 14 of the apparatus main body 10 can be lowered without changing depth of the discharge tray section 13, thereby enabling the apparatus main body 10 to be downsized in the vertical direction. Further, by arranging a part of the drawer 100 and the like in the spaces formed at the left and right sides of the discharge tray section 13 in this way, the front part of the fixed guide member 500, the front upper part of the drawer 100 (the upper part of the process cartridges 50), and the front upper part of the linear-movement cam 400 are arranged in a space below the second wall 132 of the discharge tray section 13 and the upper wall 14. Thus, the space below the second wall 132 of the discharge tray section 13 and the upper wall 14 can be utilized efficiently.

While the invention has been described in detail with reference to the above aspects thereof, it would be apparent to those skilled in the art that various changes and modifications may be made therein without departing from the scope of the claims. In the following descriptions, like parts and components are designated by the same reference numerals to avoid duplicating description.

In the above-described embodiments, the LED array 40 is illustrated as an example of the exposing member. However, the invention is not limited to this configuration. For example, a large number of light emitting elements such as EL (electroluminescence) elements, phosphors, and the like may be arranged, and these light emitting elements may be lighted selectively in accordance with image data. Alternatively, a large number of light shutters made of liquid crystal elements, PLZT, or the like may be arranged for one light source, and open/close periods of the light shutters may be controlled selectively in accordance with image data so as to control light from the light source.

In the above-described embodiments, the elongated hole 112 (more specifically, the upper edge of the elongated hole 112) formed in the side wall 110 is illustrated as an example of an engaging part for positioning the exposing member at the retracted position. However, the invention is not limited to this configuration. For example, a member separate from the side wall may be provided to engage the exposing member.

In the above-described first embodiment, the grooves (the guide groove 230 and the drawer guide groove 220) are illustrated as examples of a guide section and a supporting-member guide section. However, the invention is not limited to this configuration. For example, a wall or the like having a shape similar to the grooves in the above-described embodiments may be provided.

In the above-described embodiments, the conveying belt 71 for conveying paper P between the conveying belt 71 and the photosensitive drum 61 is illustrated as an example of a belt. However, the invention is not limited to this configuration. For example, the belt may be an intermediate transfer belt onto which a toner image on the photosensitive drum is transferred.

In the above-described first embodiment, the guide member 200 and the grooves 15 formed in the apparatus main body 10 constitute a separating mechanism. However, the invention is not limited to this configuration. For example, a combination of a guide member and a link mechanism may constitute the separating mechanism.

Figure 14:
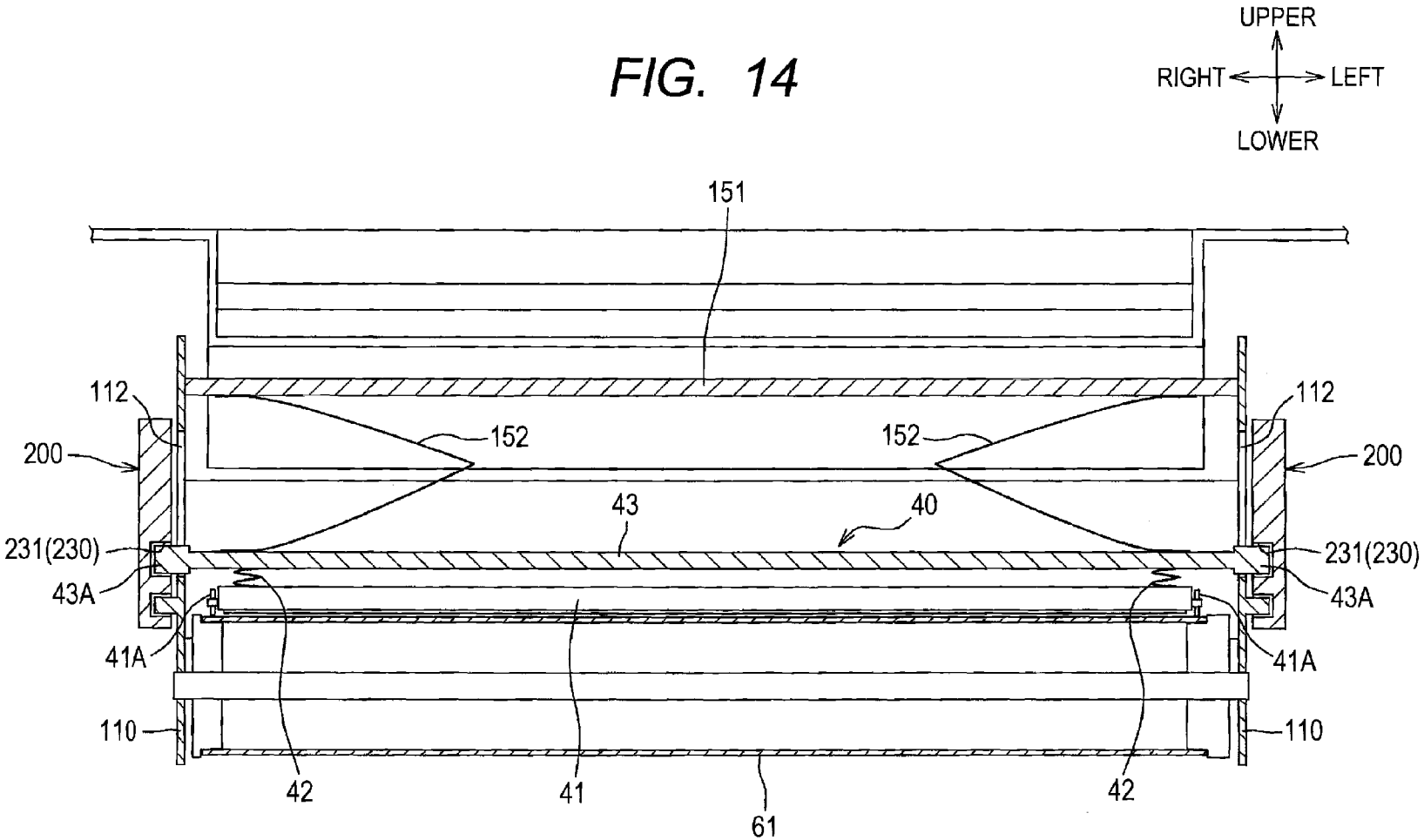
FIG. 14 is a vertical cross-sectional view showing urging members according to a modification.

In the above-described embodiments, the tension coil springs 150 are illustrated as an example of an urging member. However, the invention is not limited to this configuration. For example, leaf springs 152 shown in FIG. 14, a torsion spring, a wire spring, or the like may be used.

In the above-described embodiments, the invention is applied to the color printer 1. However, the invention is not limited to this configuration and, for example, may be applied to other kinds of image forming apparatuses such as a copier, a multifunction device, and the like.

What is claimed is:

1. An image forming apparatus comprising:

an apparatus main body having an opening and a cover;

a plurality of photosensitive drums each having both ends in an axial direction;

a plurality of exposing members each configured to expose a corresponding one of the plurality of photosensitive drums to light for forming an electrostatic latent image on the corresponding one of the plurality of photosensitive drums; and a photosensitive-drum supporting member having a pair of side walls confronting the both ends of each of the plurality of photosensitive drums, the photosensitive-drum supporting member being configured to support the plurality of photosensitive drums between the pair of side walls, the photosensitive-drum supporting member being configured to move between: a stowed position at which the photosensitive-drum supporting member is stowed within the apparatus main body; and a moved position at which the photosensitive-drum supporting member is moved from the stowed position to outside the apparatus main body through the opening, wherein the plurality of exposing members is provided at the photosensitive-drum supporting member such that the plurality of exposing members is configured to move between: an exposing position at which each of the plurality of exposing members is adjacent to the corresponding one of the plurality of photosensitive drums; and a retracted position at which each of the plurality of exposing members is separated from the corresponding one of the plurality of photosensitive drums and is engaged by an engaging part; and wherein the plurality of exposing members is accommodated within the photosensitive-drum supporting member both at the exposing position and at the retracted position, the apparatus further comprising:

an action receiving section provided at each of the plurality of exposing members, the action receiving section protruding from the pair of side walls outward in the axial direction; and an action member provided outside the pair of side walls such that the action member is configured to move relative to the photosensitive-drum supporting member, the action member being configured to contact the action receiving section so as to move the plurality of exposing members between the exposing position and the retracted position.

2. The image forming apparatus according to claim 1, wherein each of the pair of side walls is formed with a penetration section through which the action receiving section penetrates, the penetration section being configured to engage the action receiving section so as to guide each of the plurality of exposing members between the exposing position and the retracted position.

3. The image forming apparatus according to claim 2, wherein the penetration section is a hole.

4. The image forming apparatus according to claim 3, wherein the hole is an elongated hole extending in a vertical direction and having an upper edge; and wherein the upper edge of the elongated hole serves as the engaging part that engages the action receiving section when each of the plurality of exposing members is located at the retracted position.

5. The image forming apparatus according to claim 1, wherein the action member is provided at the apparatus main body.

6. The image forming apparatus according to claim 5, wherein the action member is formed with a guide section configured to engage the action receiving section; and wherein the guide section is configured to guide the action receiving section from the retracted position to the exposing position when the photosensitive-drum supporting member is mounted.

7. The image forming apparatus according to claim 6, wherein the opening is formed at a front side of the apparatus main body, a rear side being opposite the front side;

wherein the guide section comprises a sloped groove that is inclined downward toward the rear side;

wherein, when the photosensitive-drum supporting member is mounted onto the action member, the action receiving section is configured to move rearward along the sloped groove so that each of the plurality of exposing members moves downward to the exposing position; and wherein, when the photosensitive-drum supporting member is pulled out of the action member, the action receiving section is configured to move forward along the sloped groove so that each of the plurality of exposing members moves upward to the retracted position.

8. The image forming apparatus according to claim 5, wherein the action member is formed with a guide section configured to engage the action receiving section; and wherein the guide section is configured to guide the action receiving section from the retracted position to the exposing position when the cover is closed.

9. The image forming apparatus according to claim 8, wherein the opening is formed at a front side of the apparatus main body, a rear side being opposite the front side;

wherein the action member is a linear-movement cam that is configured to move rearward when the cover is opened and that is configured to move forward when the cover is closed;

wherein the guide section is a plurality of cam grooves provided at the linear-movement cam for respective ones of the plurality of exposing members, each of the plurality of cam grooves being inclined downward toward the rear side;

wherein, when the cover is closed, the action receiving section is configured to move rearward relative to the linear-movement cam and to move along the corresponding one of the plurality of cam grooves so that each of the plurality of exposing members moves downward to the exposing position; and wherein, when the cover is opened, the action receiving section is configured to move forward relative to the linear-movement cam and to move along a corresponding one of the plurality of cam grooves so that each of the plurality of exposing members moves upward to the retracted position.

10. The image forming apparatus according to claim 9, further comprising:

an arc-like gear member fixed to the cover and having a gear section;

a gear rotatably provided at the apparatus main body and configured to engage the gear section of the arc-like gear member; and a rack gear section provided at the linear-movement cam and configured to engage the gear, wherein force generated by an open or close operation of the cover is transmitted from the arc-like gear member to the rack gear section via the gear, thereby moving the linear-movement cam rearward or forward, respectively.

11. The image forming apparatus according to claim 6, wherein the action member comprises a supporting-member guide section that supports the photosensitive-drum supporting member such that the photosensitive-drum supporting member is configured to move.

12. The image forming apparatus according to claim 11, wherein the supporting-member guide section is a guide groove that is formed in a front-rear direction; and wherein the guide groove supports a protrusion provided at the photosensitive-drum supporting member such that the protrusion is configured to move along the guide groove when the photosensitive-drum supporting member is mounted onto and pulled out of the action member.

13. The image forming apparatus according to claim 11, further comprising:

a belt provided at the apparatus main body and disposed below the plurality of photosensitive drums to confront the plurality of photosensitive drums; and a separating mechanism configured to support the photosensitive-drum supporting member such that the action member is configured to move upward and downward, thereby moving the photosensitive-drum supporting member upward and downward, so that the plurality of photosensitive drums is configured to move between: a contact position at which the plurality of photosensitive drums is in contact with the belt; and a separated position at which the plurality of photosensitive drums is separated from the belt.

14. The image forming apparatus according to claim 13, further comprising:

a cover provided at the apparatus main body and configured to move between a closed position at which the opening is closed and an open position at which the opening is opened; and an interlocking mechanism configured to interlock the cover with the separating mechanism such that the action member is displaced from the contact position to the separated position when the cover moves from the closed position to the open position.

15. The image forming apparatus according to claim 5, wherein the photosensitive-drum supporting member comprises an urging member configured to urge a corresponding one of the plurality of exposing members in a direction away from a corresponding one of the plurality of photosensitive drums.

16. The image forming apparatus according to claim 1, further comprising a plurality of process cartridges each comprising:

a developer container configured to accommodate developer;

a corresponding one of the plurality of photosensitive drums; and a developing roller configured to supply the corresponding one of the plurality of photosensitive drums with the developer within the developer container, wherein each of the plurality of process cartridges is configured to move in an arc shape relative to the photosensitive-drum supporting member when the each of the plurality of process cartridges is mounted and dismounted.

17. An image forming apparatus comprising:

an apparatus main body having an opening;

a plurality of photosensitive drums each having both ends in an axial direction;

a plurality of exposing members each configured to expose a corresponding one of the plurality of photosensitive drums to light for forming an electrostatic latent image on the corresponding one of the plurality of photosensitive drums;

a photosensitive-drum supporting member having a pair of side walls confronting the both ends of each of the plurality of photosensitive drums, the photosensitive-drum supporting member being configured to support the plurality of photosensitive drums between the pair of side walls, the photosensitive-drum supporting member being configured to move between: a stowed position at which the photosensitive-drum supporting member is stowed within the apparatus main body; and a moved position at which the photosensitive-drum supporting member is moved from the stowed position to outside the apparatus main body through the opening, wherein the plurality of exposing members is provided at the photosensitive-drum supporting member such that the plurality of exposing members is configured to move between: an exposing position at which each of the plurality of exposing members is adjacent to the corresponding one of the plurality of photosensitive drums; and a retracted position at which each of the plurality of exposing members is separated from the corresponding one of the plurality of photosensitive drums; and an engaging part provided for each of the plurality of exposing members, the engaging part being configured to hold a corresponding one of the plurality of exposing members at the retracted position in which the plurality of photosensitive drums and the plurality of exposing members are accommodated with the photosensitive-drum supporting member.

* * * * *